US006796067B2

(12) United States Patent
Popikow

(10) Patent No.: US 6,796,067 B2
(45) Date of Patent: Sep. 28, 2004

(54) LOCK SYSTEM FOR MULTIBARREL GUNS

(75) Inventor: Sergej Popikow, Weitnau (DE)

(73) Assignee: S.A.T. Swiss Arms Technology AG, Neuhausen (CH)

( * ) Notice: Subject to any disclaimer, the term of this patent is extended or adjusted under 35 U.S.C. 154(b) by 0 days.

(21) Appl. No.: 10/664,816

(22) Filed: Sep. 17, 2003

(65) Prior Publication Data

US 2004/0128897 A1 Jul. 8, 2004

Related U.S. Application Data

(63) Continuation of application No. PCT/EP02/03788, filed on Apr. 5, 2002.

(51) Int. Cl.[7] ..... F41A 3/00
(52) U.S. Cl. ..... 42/42.01; 42/69.01
(58) Field of Search ..... 42/42.01, 69.01, 42/41, 42.02

(56) References Cited

U.S. PATENT DOCUMENTS

| | | | | |
|---|---|---|---|---|
| 1,890,005 A | * | 12/1932 | Stiennon | 42/42.01 |
| 2,001,278 A | * | 5/1935 | Loomis | 42/42.01 |
| 3,193,961 A | | 7/1965 | Linarello | |
| 4,091,556 A | * | 5/1978 | Katsenes | 42/42.01 |
| 4,310,981 A | * | 1/1982 | Waddell | 42/42.01 |
| 4,403,436 A | | 9/1983 | Jennie | |
| 4,545,143 A | | 10/1985 | Schultz | |

FOREIGN PATENT DOCUMENTS

| | | |
|---|---|---|
| DE | 40 26 482 A1 | 10/1991 |
| DE | 197 49 290 A1 | 5/1999 |
| EP | 0 277 922 A2 | 8/1988 |
| EP | 0 592 103 A1 | 4/1994 |

* cited by examiner

*Primary Examiner*—Michael J. Carone
*Assistant Examiner*—M. Thomson
(74) *Attorney, Agent, or Firm*—Martin Fleit; Paul D. Bianco; Fleit Kain Gibbons Gutman Bongini & Bianco

(57) ABSTRACT

A lock system for a multi-barrel gun with at least two movably arranged firing pin pieces and a trigger device that has sears associated with the firing pin pieces, at least one trigger, and a switching mechanism for automatically connecting the trigger to the sear of the not yet released second firing pin piece after the firing of a first shot as a consequence of an actuation of the sear of the first firing pin piece for its release by the trigger. The switching mechanism has a base body that can shift in the direction of the longitudinal axis of the gun. The base body includes a firing lever rotatably arranged on it that can be actuated by the trigger, that is at an interval from the sears in the cocked state of the firing pin pieces and that does not engage with the sear belonging to the second firing pin piece for firing the second shot until after completion of the spring-back of the weapon.

14 Claims, 5 Drawing Sheets

LOCK SYSTEM FOR MULTIBARREL GUNS

RELATED APPLICATION

This application is a continuation of International Patent Application No. PCT/EP02/03788 filed Apr. 5, 2002, which is here incorporated by reference in its entirety.

BACKGROUND OF THE INVENTION

1. Field of the Invention

The invention relates to a lock system for multi-barrel guns having at least two movably arranged firing pin pieces.

2. Prior Art

DE 197 49 290 A1 discloses a generic lock system for double-barreled guns. Here, two adjacently arranged firing pin pieces, each loaded by a mainspring, are held in their cocked positions by their individual locking levers. In order to successively release the two firing pin pieces with a common trigger, a switching piece is pivotably articulated onto the trigger blade of this trigger and brought into a switching position with a spring after a first actuation of the trigger. In the switching position the switching piece, pivoted to the front, establishes the connection between the trigger and the locking lever belonging to the second firing pin piece for releasing the second firing pin piece upon a second actuation of the trigger. In order to avoid a so-called doubling, that is, an unintentional firing of the second shot when firing the intended first shot, a pendulum mass that can pivot about a second pivot axis is arranged in the breech housing and holds the switching piece during the recoil movement of the gun as well as during the subsequent spring-back from the body of the sharpshooter in a passive position until the gun has come to rest again. However, such a lock system has a relatively complex design and requires a correspondingly high expense for manufacture and assembly.

SUMMARY OF THE INVENTION

The invention deals with the problem of creating a rugged locking system for multi-barrel guns that is simple to assemble, can be universally used and has a high degree of operational safety.

The problem of the prior art is solved by providing a unique lock system according to the invention. More particularly, the invention provides a lock system for a multi-barrel gun with at least two movably arranged firing pin pieces and a trigger device that comprises sears associated with the firing pin pieces, at least one trigger, and a switching mechanism for automatically connecting the trigger to the sear of the not yet released second firing pin piece after the firing of a first shot as a consequence of an actuation of the sear of the first firing pin piece for its release by the trigger, characterized in that the switching mechanism comprises a base body that can shift in the direction of the longitudinal axis of the gun, which base body comprises a firing lever rotatably arranged on it that can be actuated by the trigger, that is at an interval from the sears in the cocked state of the firing pin pieces and that does not engage with the sear belonging to the second firing pin piece for firing the second shot until after completion of the spring-back of the weapon.

Advantageous refinements and purposeful embodiments of the invention can be gathered from the detailed description that follows.

A significant advantage of the lock system in accordance with the invention consists in its simple assembly and universal applicability in combination with various trigger systems. Various trigger systems can be used in a simple manner depending on the requirements of the sharpshooter and how the weapon is to be used. All one needs to do is to remove the appropriate bearing pins and holding pins and exchange the appropriate triggers. Moreover, the lock system offers the possibility of a simple manual switching so that a second shot can be fired relatively rapidly even given a disturbance of the automatic switching system. This can bring about an improvement of the operational safety. When both firing pin pieces are located in their cocked position, the firing lever and the base body forming the switching mass are separated from the sears. This achieves greater safety against the unintentional release of a shot. In addition, the lock system is less sensitive to jolts.

The lock system in accordance with the invention comprises parts that can shift substantially in the longitudinal direction of the weapon. Thus, the lock can be designed to be extremely compact and does not require a great amount of space.

Other particularities and advantages of the invention result from the following description of a preferred exemplary embodiment with reference made to the drawings.

DETAILED DESCRIPTION OF PREFERRED EMBODIMENTS OF THE INVENTION

Figure 1:
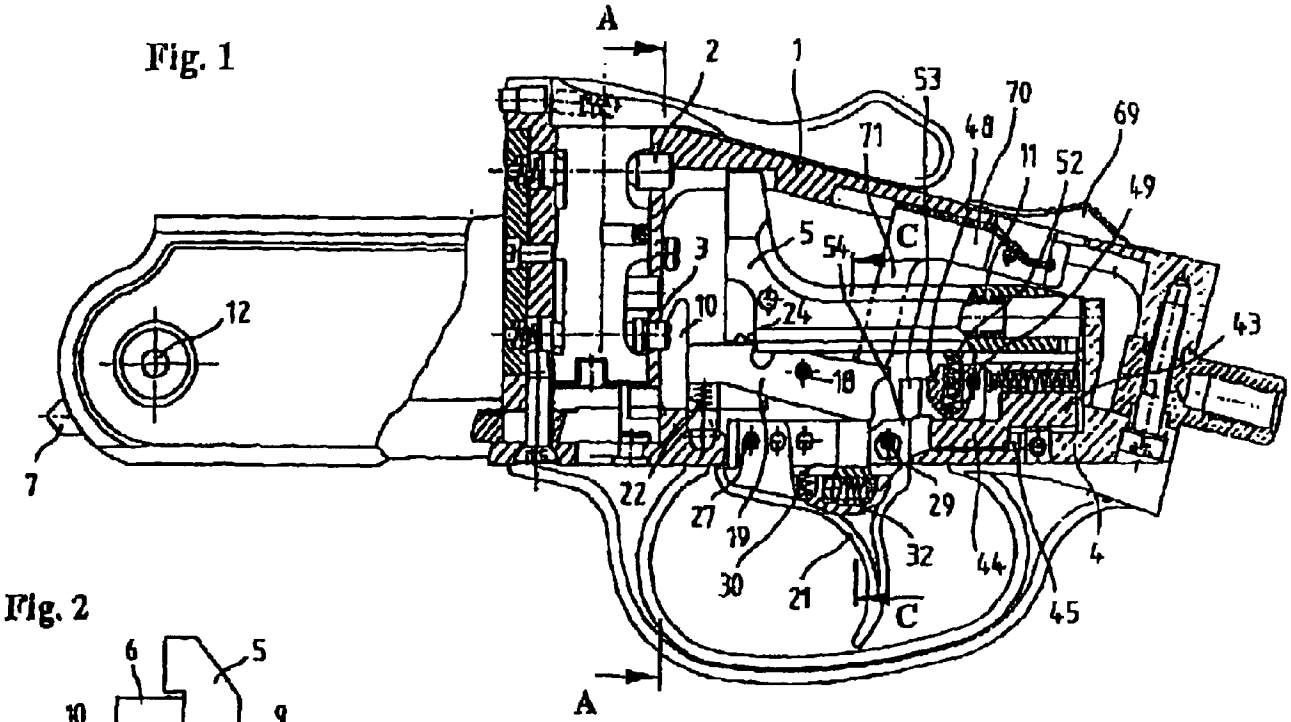
FIG. 1 shows a lock system of a double-barreled, tilt-up barrel weapon with a trigger device designed as a single trigger in a lateral view in partial section.
Figure 2:
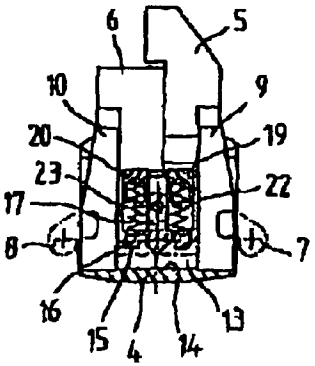
FIG. 2 shows a partial view in the direction of arrows A—A in FIG. 1.

FIG. 1 shows breech housing 1 of a multi-barrel tilt-up barrel weapon in which an upper and a lower striking pin 2, 3 for two superposed barrels are guided in such a manner that they can shift axially. Lock plate 4 with the lock parts arranged on it is detachably mounted on the bottom of breech housing 1. As FIG. 2 shows in particular, lock plate 4 carries two firing pin pieces 5, 6 that are arranged adjacent to one another, can be shifted parallel to the longitudinal axis of the tilt-up barrel weapon and can be actuated separately for one another. Moreover, two cocking rods 7, 8 shown in dotted lines in FIG. 2 are arranged in breech housing 1 by means of which rods the two firing pin pieces 5, 6 can be shifted via locking levers 9, 10 against the force of mainspring 11 shown in FIG. 1 into a withdrawn cocking position. Cocking rods 7, 8 are arranged in such a manner that they are shifted to the rear during the tilting of a barrel part (not shown), arranged in such a manner that it can tilt about swivel joint 12 on breech housing 1, pressing the two firing pin pieces 5, 6 via cocking levers 9,10 to the rear. The two cocking levers 9, 10, that are designed in a mirror-inverted manner, are articulated via lateral articulation pins 13 in a pivotable manner in transverse bore 14 in lock plate 4. Articulation pins 13, which are beveled off on their front side, display upper groove 15 into which two parallel webs 16 on the bottom of holding piece 17 arranged in a corresponding recess in lock plate 4 engage. This fixes the two cocking levers 9, 10 and secures them against falling out.

Two lever-shaped sears 19, 20 arranged in such a manner that they can rotate about cross pin 18 are mounted below the two firing pin pieces 5, 6 on lock plate 4 and establish the connection between a trigger 21 and the two firing pin pieces 5, 6. Notch 24 for holding the particular firing pin piece 5 or 6 in its cocked withdrawn position is formed on the front end of the two sears 19, 20, which end is loaded upward by a respective pressure spring 22, 23. The two pressure springs 22, 23 rest with their lower end on holding piece 17 and are arranged with their upper ends in corresponding bores on the bottom of sears 19, 20. In this manner the two pressure springs 22, 23 load the front ends of the two sears 19, 20 upward and also press holding piece 17 down for laterally holding the two cocking levers 9, 10. The rear ends of sears 19, 20 are actuated by a trigger device designed in the embodiment shown in FIG. 1 as a single-trigger system for firing two successive shots out of the upper and the lower barrel with a single trigger 21.

Figure 4:
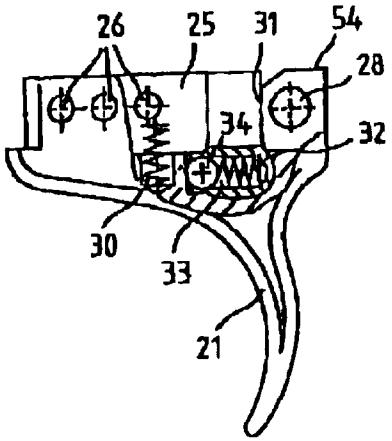
FIG. 4 shows a trigger of the single trigger system shown in FIG. 1 with a switching button in a lateral view.

In the single-trigger system shown in FIG. 1, trigger 21 individually shown in a lateral view in FIG. 4, displays three adjacent front cross bores 26 in trigger blade 25 for receiving bearing pin 27 running transversely through lock plate 4 and displays rear through bore 28 for holding pin 29 limiting the trigger movement. The trigger force can be adjusted by selecting one of the three adjacently arranged cross bores 26 as the bearing bore for trigger 21. Rear through-bore 28 has a larger diameter than holding pin 29 and limits the possibility of movement of trigger 21. Trigger 21 is pressed into its front initial position by small trigger spring 30.

According to FIG. 4, recess 31 is provided between front cross bores 26 and rear through bore 28 in trigger blade 25 in which recess switching button 32 is arranged in such a manner that it can shift laterally. Front bore 33, in which spring-loaded latch sphere 34 is housed, is located in switching button 32. Two adjacent sphere receptacles 35 are located on an inner side of recess 31, into which receptacles latch sphere 34 can engage in order to hold switching button 32 in two switching positions.

Figure 6:
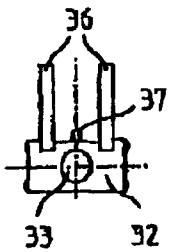
FIG. 6 shows a switching button of the trigger of FIG. 4 in a front view.

Switching button 32 shown in a front view in FIG. 6 comprises two parallel, upwardly projecting webs 36 via which the sear 19 or 20 belonging to the one or the other firing pin piece can be selectively actuated in order to release a shot out of the upper or the lower barrel. It is possible to select, by appropriately shifting switching button 32, whether the upper or the lower barrel is fired first with trigger 21. Moreover, central safety rib 37 projects upward between the two webs 36, the function of which rib will be explained in detail later.

Figure 8:
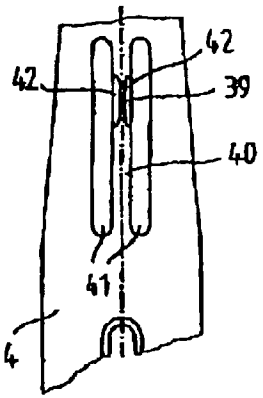
FIG. 8 shows a partial view of the lock plate without trigger in a bottom view.
Figure 7:
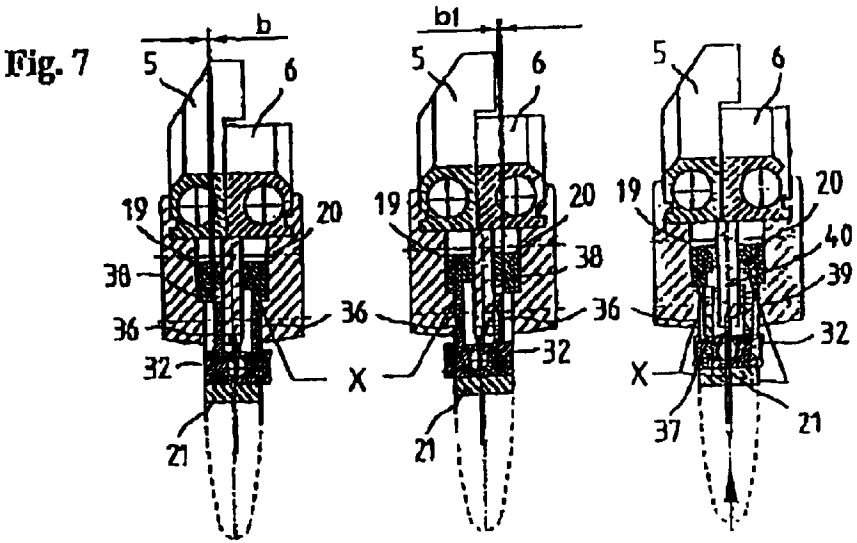
FIG. 7 shows a sectional view of the trigger device in the direction of arrows C—C in FIG. 1 with different positions of the switching button.

FIG. 7 shows the various switching positions of laterally switchable switching button 32. In a switching position shown on the left side, switching button 32 projects to the right relative to trigger 21. In this position right web 36 makes contact with the rear part of sear 20 while left web 36 engages into lateral groove 38 on the bottom of sear 19 at a given lateral gap b at a distance from sear 19. If trigger 21 is actuated for the first time in this position, the rear end of sear 20 is raised via right web 36. During this time notch 24 arranged on the front end of sear 20 frees firing pin piece 6 so that the latter can strike firing pin 9 belonging to the lower barrel as a result of the tension of mainspring 11. In contrast thereto, left web 36 of switching button 32 does not make contact with sear 19 when trigger 21 is actuated, so that the upper barrel is not fired upon the first actuation of trigger 21. On the other hand, if the first shot is to be fired from the other barrel, switching button 32 can be shifted into the other switching position shown in the middle of FIG. 7. Left web 36 then makes contact with sear 19 while right web 36 comes out of contact with the other sear 20. Then, during the first actuation of trigger 21 the rear end of sear 19 is raised via left web 36 of switching button 32 while right web 36 engages into lateral groove 38 on the bottom of sear 20 and with lateral gap b1 at a distance from sear 20. This causes firing pin piece 5 to fire a shot from the upper barrel. The contact points between webs 36 and sears 19, 20 are characterized in FIG. 7 with an X for clarification. If switching button 32 is inadvertently not in a right or left switching position given by latch sphere 34 and sphere receptacles 35 but rather in a middle position shown on the right side of FIG. 7, safety rib 37 arranged between the two webs 36 makes contact with narrow area 39, also perceivable in FIG. 8, of middle web 40 in lock plate 4. This blocks trigger 21 so that a simultaneous firing of both barrels can be prevented. Middle web 40 is located between two oblong slots 41 through which the upper parts of trigger blade 25 extend. On the other hand, in the right and the left switching position of switching button 32, middle web 37 engages into a right or left lateral recess 42 on middle web 40 so that trigger 21 can be activated.

Figure 3:
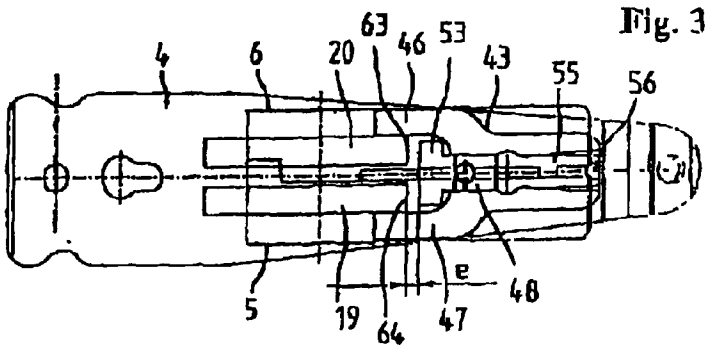
FIG. 3 shows a top view onto a lock plate with a switching mechanism.

In order to automatically switch from the one barrel to the second barrel after firing the first shot, a switching mechanism shown in FIGS. 1, 3 is arranged below the two firing pin pieces 5, 6 which switching mechanism displays parts separately represented in FIGS. 10, 11. The switching mechanism comprises fork-shaped base body 43 arranged below the two firing pin pieces 5, 6 and guided via lower guide part 44 in the longitudinal direction of the tilt-up barrel weapon in such a manner that it can be shifted onto lock plate 4. Lower guide part 44 is arranged in such a manner that it can shift in corresponding recess 45 of lock plate 4.

Figure 5:
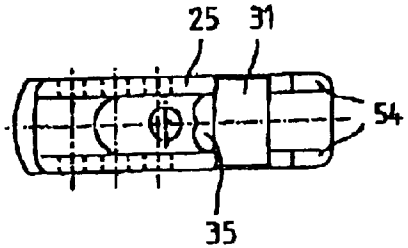
FIG. 5 shows the trigger of FIG. 4 without switching button in a top view.
Figure 9:
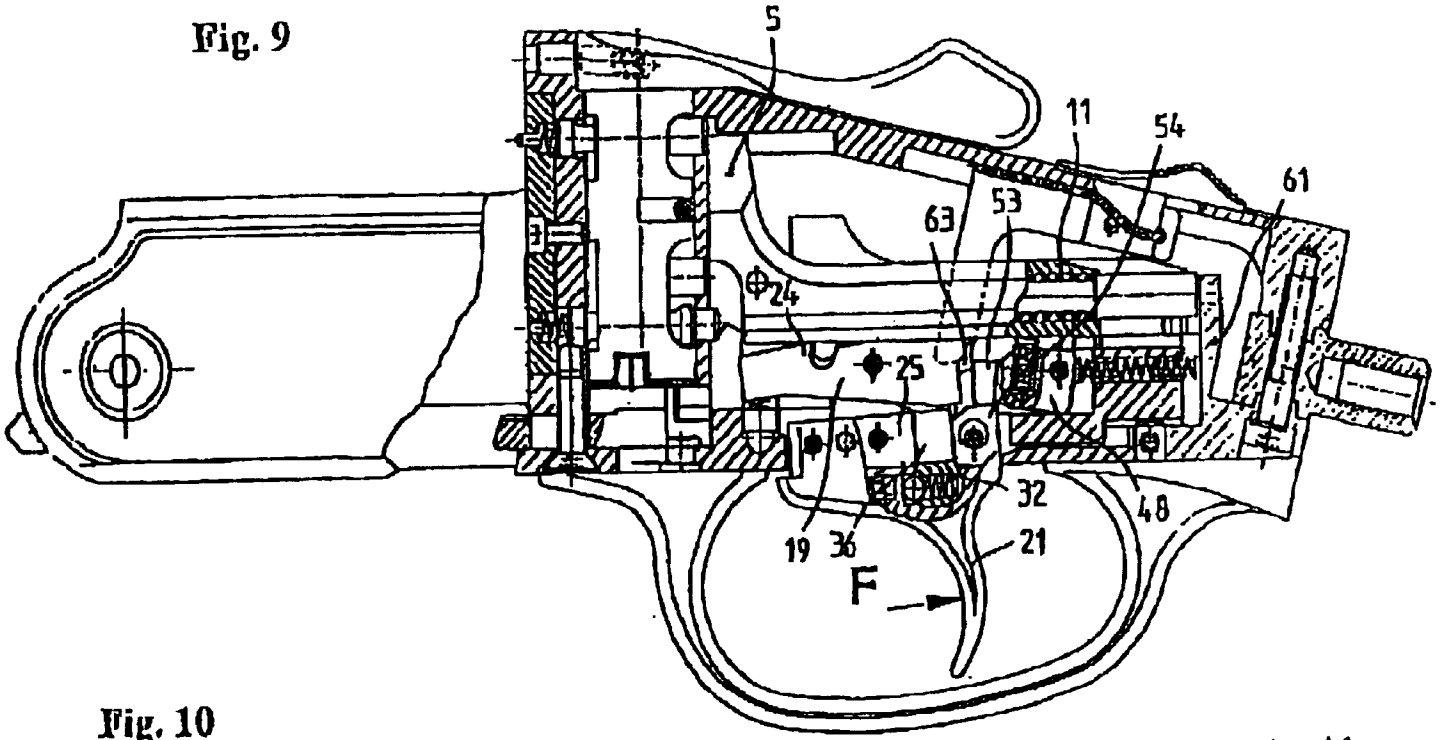
FIG. 9 shows the trigger device of FIG. 1 immediately after firing the first shot out of the upper barrel.
Figure 11:
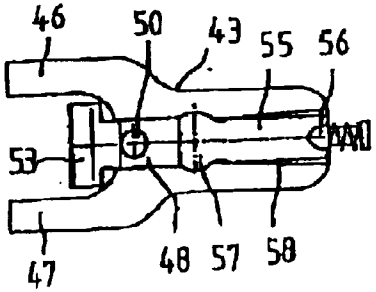
FIG. 11 shows the switching mechanism of FIG. 10 in a top view.
Figure 10:
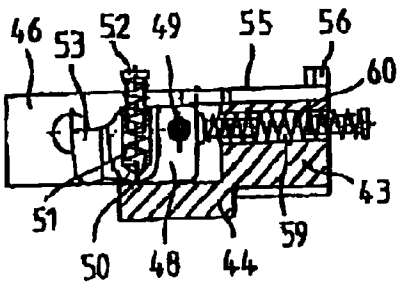
FIG. 10 shows a switching mechanism in partial section in a lateral view.

As is evident in particular from FIGS. 10, 11, firing lever 48 is articulated in such a manner that it can rotate about transverse pin 49 between the two parallel shanks 46, 47 of fork-shaped base body 43. Spring 51 is arranged in blind bore 50 arranged on the top of firing lever 48. This spring is supported according to FIG. 1 by its upper end via guide pin 52 on the bottom of firing pin pieces 5, 6. A front end 53 of firing lever 48 is pressed via spring 51 against two parallel rear webs 54 of trigger blade 25, which can be better perceived in FIGS. 4, 5. Plate-shaped switching part 55 with wedge-shaped pressure piece 56 projecting upward on the rear end is arranged on top of base body 43 in such a manner that it can shift by a given angular amount to both sides. Switching part 55 comprises a substantially circular front end 57 rotatably guided in a correspondingly shaped part of recess 58 on top of base body 43. Recess 58 is widened out to the rear in a wedge shape for a lateral switching of switching part 55. The position of base body 43 and a firing lever 48 is determined via wedge-shaped pressure piece 56 as a function of the position of firing pin pieces 5, 6, as will be explained in detail in the following. Helical spring 60 is arranged in through longitudinal bore 59 of base body 43. This spring is supported via two end guide pieces on a back side of firing lever 48 and a back wall of lock plate 4 designated in FIG. 9 by reference numeral 61.

The lock system for a double-barreled tilt-up barrel weapon described above operates as follows.

In the cocked position the parts of the lock system described above assume the position shown in FIGS. 1 to 3. The two firing pin pieces 5, 6 are held by their particular sears 19, 20 in their withdrawn position. Also base body 43 with firing lever 48 articulated to it is held in the withdrawn position via wedge-shaped pressure piece 56 of switching part 55 which piece rests on the back side of firing pin pieces 5, 6. In this position front end 53 of firing lever 48 is spaced according to FIG. 3 by a given interval e from the respective rear, nose-shaped projections 63 and 64 of firing levers 19 and 20. Thus, in this cocked position no direct connection is present between firing lever 48 and sears 19, 20.

Figure 12:
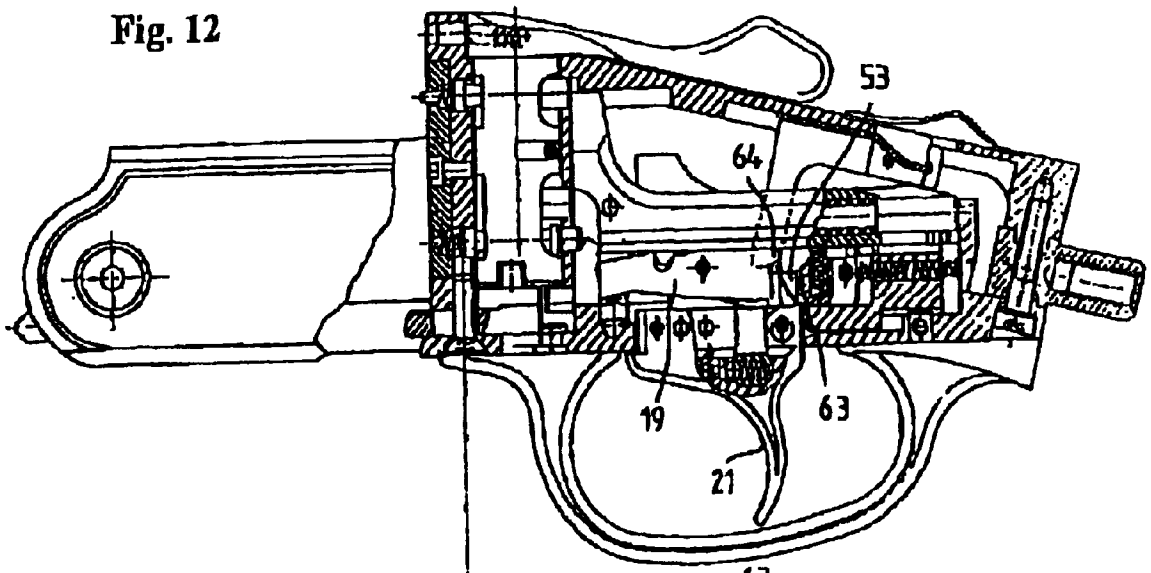
FIG. 12 shows the trigger device of FIG. 1 after firing the first shot and the engaging of the switching system for firing the second shot.
Figure 13:
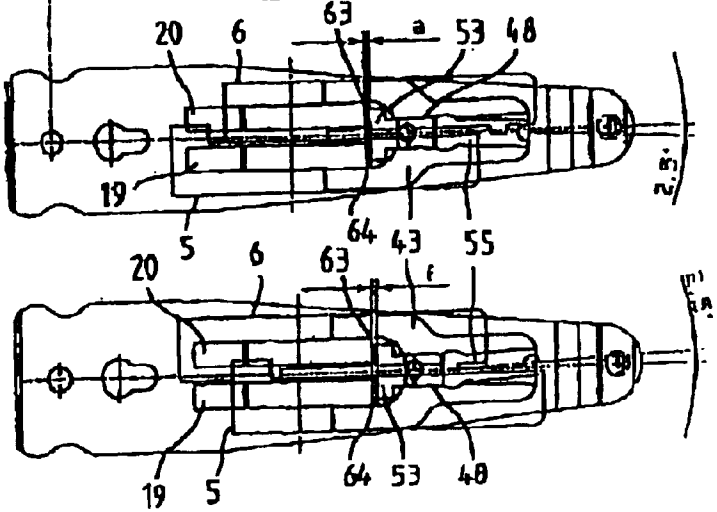
FIG. 13 shows a top view onto the switching mechanism in various positions after the firing of the first shot from the upper or the lower barrel.

If trigger 21 is actuated, at first the rear end either of the right or of the left sear 19 or 20 is raised by webs 36 of switching button 35 as a function of the position of switching button 32, wherein notch 24 located on the front end of firing levers 19, 20 releases associated firing pin piece 5 or 6. If switching button 32 is located, e.g., in the position shown in the middle representation according to FIG. 7, firing piece pin 5 is released for firing a shot from an upper barrel upon the first actuation of trigger 21. If this piece is moved forward under the action of mainspring 11, switching part 55 that can pivot through 2.5° to both sides moves laterally, as can be perceived in the upper presentation of FIG. 13. On the other hand, if switching button 32 is located in the other switching position, upon the first actuation of trigger 21 firing pin piece 6 is released first for firing a shot out of a lower barrel. Switching part 55 then moves to the other side, as is shown in the lower presentation in FIG. 13. If switching part 55 moves to the side on account of the forward movement of one of firing pin pieces 5 or 6, base body 43 can also move forward under the action of helical spring 60 in accordance with FIG. 12 so that front end 53 of firing lever 48 can move under nose-shaped projection 63 or 64 of the sear belonging to the not yet released firing pin piece. This is illustrated in FIG. 13 by reference numerals a and e. If trigger 21 is then actuated a second time, the rear end of the other sear is raised by the firing lever, whereby the firing pin piece for firing a shot out of the second barrel is released.

The mechanism for avoiding an unintentional firing of the second shot during the recoil movement and the spring-back of the gun after the firing of the intended first shot is explained in the following using FIG. 9, which shows the state of the lock system of the invention during the actuation of trigger 21 for firing the first shot. The rear end of sear 19 is raised by web 36 of switching button 32 by actuating trigger 21, wherein notch 24 arranged on the front end releases firing pin piece 5. At the same time firing lever 48 resting on rear webs 54 of trigger blade 25 is also pivoted upward. The firing pin piece is moved forward in the direction of the striking pin by the cocking of striker pin 11. Also base body 43 now released via switching part 55 and with firing lever 48 pivotably arranged on it is pressed forward by helical spring 60. However, as long as trigger 21 is actuated, front end 53 of firing lever 48 cannot move under nose-shaped projection 63 of the other sear 20, but rather is pressed against its rear edge. In this position second firing pin piece 6 cannot be released.

A recoil force directed toward the sharpshooter that moves the gun to the rear is produced during the firing of the shot. Due to the mass moment of inertia of base body 43, front end 53 of firing lever 48 continues to be pressed against the rear edge of sear 20 so that the front end can not move under projection 63 during the retrograde movement of the gun itself when the shooting finger leaves the trigger and trigger 21 is moved forward by spring 30.

There is the danger when the gun jumps back from the shoulder of the sharpshooter after the end of the recoil movement that trigger 21 will bounce against the shooting finger and be unintentionally actuated. However, during the actuation of trigger 21, firing lever 48 is simultaneously raised, which prevents front end 53 from moving under projection 63 of the sear. Firing lever 48 cannot move with its front end 53 under projection 63 or 64 of the corresponding sear 19 or 20 in order to fire the second shot until the spring-back has ended and trigger 21 is in its initial position.

Figure 14:
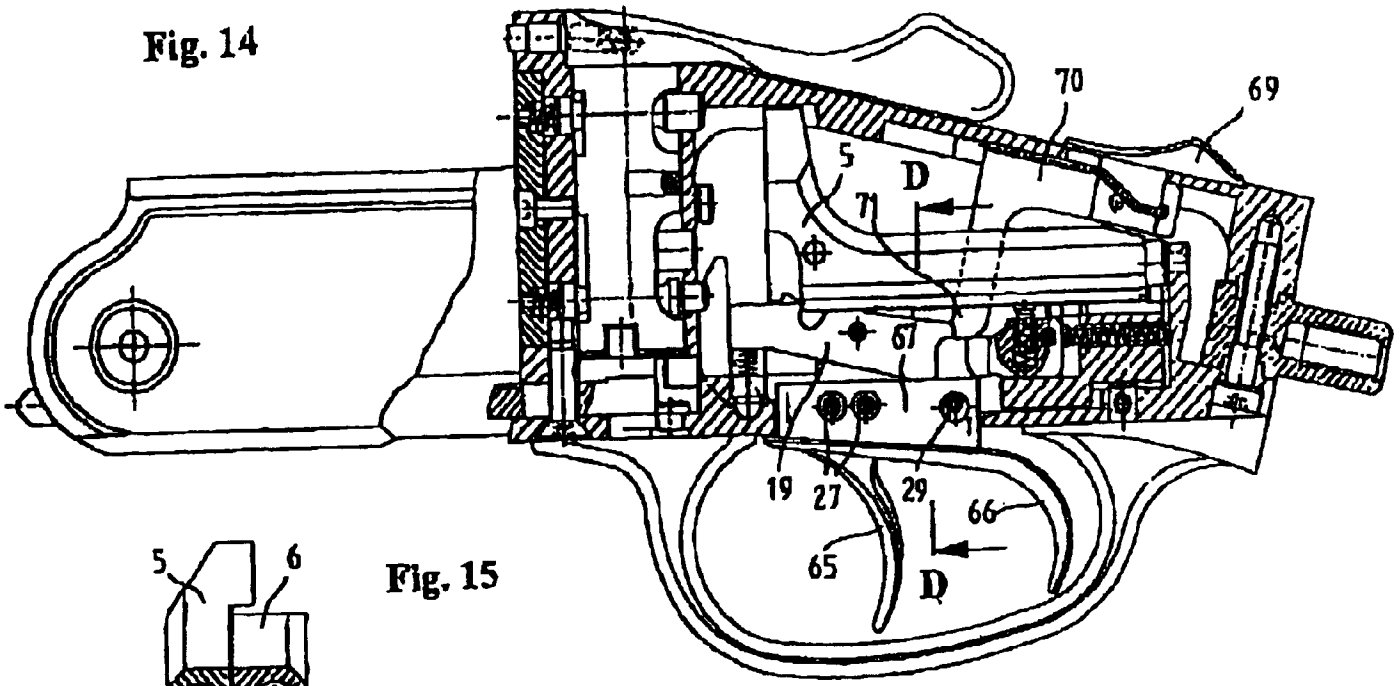
FIG. 14 shows a lock system with a trigger device designed as a dual combination trigger.
Figure 15:
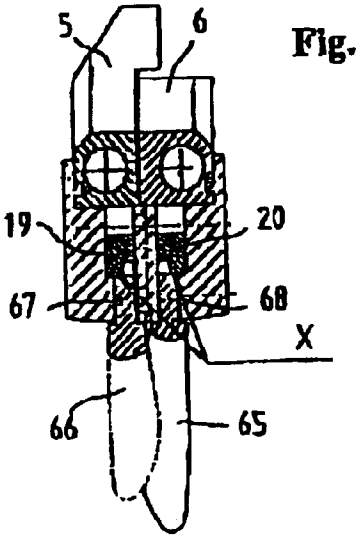
FIG. 15 shows a view in the direction of arrows D—D of FIG. 14.

The above lock system is intended not only for a single trigger. It can also be used in combination with other trigger systems, in which case a rapid changing between the different trigger systems is possible. FIGS. 14, 15 show the lock system of the invention in conjunction with a so-called dual combination trigger. In this embodiment a front trigger 65 and a rear trigger 66 are provided, each of which can operate both barrels. As is apparent from FIG. 15, sear 19 rests on upwardly projecting trigger blade 67 of rear trigger 66. The other sear 20 rests on correspondingly upwardly projecting trigger blade 68 of front trigger 65. Both sears 19, 20 are in constant contact with the two triggers 65, 66, which is indicated by reference designator X. In this trigger system the first shot can be fired by actuating the front or the rear trigger. After the firing of the first shot the previously described switching mechanism automatically switches over, so that the next shot can be fired from the other barrel with the same trigger. However, the next shot can also be fired with the other trigger as required or if there is a problem with the switching mechanism.

The different triggers can be exchanged very readily. Only bearing pins 27 and holding pin 29 have to be removed. Other triggers can then be used as required.

An additional safety for preventing an unintentional firing of a shot is provided on breech housing 1. This safety consists of an L-shaped security lever 70 that can be moved via slider 69, which lever comes to rest with its downward projecting shank 71 on front end 53 of firing lever 48 in a safety position shown in FIG. 1 and prevents the rotation of said lever and also prevents the actuation of trigger 21. In the withdrawn position of slider 69 shown in FIG. 14, downwardly projecting shank 71 of safety lever 70 releases the firing lever so that the trigger can be actuated.

The invention is not limited to the exemplary embodiments described above and shown in the drawings. It can also be used, e.g., in guns with adjacent barrels with corresponding advantages. In addition to the described single trigger with the manual switching device or selector and the so-called dual combination trigger, a single trigger without selector or two normal triggers can also be used.

What is claimed is:

1. A lock system for a multi-barrel gun with at least two movably arranged firing pin pieces and a trigger device that comprises sears associated with the firing pin pieces, at least one trigger, and a switching mechanism for automatically connecting the trigger to the sear of the not yet released second firing pin piece after the firing of a first shot as a consequence of an actuation of the sear of the first firing pin piece for its release by the trigger, characterized in that the switching mechanism comprises a base body that can shift in the direction of the longitudinal axis of the gun, which base body comprises a firing lever rotatably arranged on it that can be actuated by the trigger, that is at an interval from the sears in the cocked state of the firing pin pieces and that does not engage with the sear belonging to the second firing pin piece for firing the second shot until after completion of the spring-back of the weapon.

2. The lock system according to claim 1, characterized in that the base body is arranged so that it can shift on a lock plate.

3. The lock system according to claim 2, characterized in that the firing pin pieces are arranged on the lock plate in such a manner that they can shift in the longitudinal direction of the gun.

4. The lock system according to claim 1, characterized in that a switching part is arranged on the base body for controlling the forward movement of the base body as a function of the shifting of the firing pin pieces.

5. The lock system according to claim 4, characterized in that the switching part comprises a wedge-shaped pressure piece that rests on the firing pin pieces.

6. The lock system according to claim 4, characterized in that the switching part can be moved laterally to both sides by a given angular amount relative to initial position.

7. The lock system according to claim 1, characterized in that the firing lever comprises a front end that can be raised and lowered by the trigger and that can be brought in the lowered position into engagement with the firing sears for releasing a second shot.

8. The lock system according to claim 7, characterized in that the firing lever rests on the trigger and that its front end is loaded by a spring into the lowered position.

9. The lock system according to claim 1, characterized in that the trigger is designed as a single trigger.

10. The lock system according to claim 8, characterized in that the trigger designed as a single trigger comprises a switching device for manually selecting a barrel for firing the first shot.

11. The lock system according to claim 10, characterized in that the switching device comprises a switching button that can shift laterally in the trigger and comprises two parallel webs for the actuation one of the two sears.

12. The lock system according to claim 11, characterized in that safety rib cooperating with a middle web on the lock plate is arranged on the switching button for preventing a simultaneous firing of two shots.

13. The lock system according to claim 1, characterized in that a safety is associated with the firing lever for preventing an unintended release of a shot.

14. The lock system according to claim 13, characterized in that the safety associated with the firing lever consists of an L-shaped safety lever that can be shifted by a slider and with whose shank the firing lever can be blocked.

* * * * *

UNITED STATES PATENT AND TRADEMARK OFFICE

CERTIFICATE OF CORRECTION

PATENT NO. : 6,796,067 B2
DATED : September 28, 2004
INVENTOR(S) : Sergej Popikow It is certified that error appears in the above-identified patent and that said Letters Patent is hereby corrected as shown below:

Title page,
Item [30], Foreign Application Priority Data, should read
-- April 11, 2001 (DE)…….. 101 18 046.2 --.

Signed and Sealed this

Twenty-third Day of August, 2005

JON W. DUDAS
*Director of the United States Patent and Trademark Office*